US009150349B2

(12) United States Patent
Hall et al.

(10) Patent No.: US 9,150,349 B2
(45) Date of Patent: Oct. 6, 2015

(54) STORAGE APPARATUS HAVING TANK WITH TAPERED BOTTOM AND AXLE ASSEMBLY

(71) Applicant: BAKERCORP, Seal Beach, CA (US)

(72) Inventors: Dan Hall, Seal Beach, CA (US); Derek Reamy, Seal Beach, CA (US); Stephen Erekson, Ogden, UT (US); Bruce H. White, Ogden, UT (US); Mark Fluckiger, Ogden, UT (US); Casey Hislop, Ogden, UT (US); Rodney Keller, Ogden, UT (US)

(73) Assignee: BAKERCORP, Seal Beach, CA (US)

( * ) Notice: Subject to any disclaimer, the term of this patent is extended or adjusted under 35 U.S.C. 154(b) by 0 days.

(21) Appl. No.: 14/463,576

(22) Filed: Aug. 19, 2014

(65) Prior Publication Data

US 2015/0053292 A1 Feb. 26, 2015

Related U.S. Application Data

(60) Provisional application No. 61/868,015, filed on Aug. 20, 2013.

(51) Int. Cl.

| | |
|---|---|
| ***B65D 88/30*** | (2006.01) |
| ***B65D 88/32*** | (2006.01) |
| ***B60P 3/22*** | (2006.01) |

(Continued)

(52) U.S. Cl.

CPC ..... *B65D 88/30* (2013.01); *B65D 90/0093* (2013.01); *B65D 90/18* (2013.01); *B65D 88/32* (2013.01); *B65D 2590/0091* (2013.01); *Y10T 137/691* (2015.04)

(58) Field of Classification Search

USPC ..... 137/899, 899.3, 15.04, 15.05, 237, 238, 137/240; 280/837, 839; 414/332, 812, 919; 134/166 C, 167 C, 167 R, 168 C, 168 R, 134/169 C, 169 R, 170, 171, 22.1, 22.18

See application file for complete search history.

(56) References Cited

U.S. PATENT DOCUMENTS

| | | | | |
|---|---|---|---|---|
| 1,260,947 | A * | 3/1918 | Sperry et al. | 134/167 R |
| 3,322,347 | A * | 5/1967 | Pierce | 239/73 |
| 3,407,179 | A * | 10/1968 | Carr | 526/71 |

(Continued)

OTHER PUBLICATIONS

International Search Report and Written Opinion issued on Dec. 4, 2014 in PCT/US14/51751.

(Continued)

*Primary Examiner* — Craig Schneider
*Assistant Examiner* — Jonathan Waddy
(74) *Attorney, Agent, or Firm* — Jeffer Mangels; Butler & Mitchell LLP; Brennan C. Swain, Esq.

(57) ABSTRACT

A portable tank assembly that is movable between an operating position and a transport position that includes a tank assembly with a holding tank having an upper section that includes an upper wall and a lower section that includes a lower wall that tapers inwardly from the upper wall to form an orifice, a transport assembly that includes a base portion and an axle assembly. The base portion is affixed to the upper section of the holding tank, and the axle assembly includes wheels for transporting the holding tank along a surface, and a skid assembly that includes a skid plate configured to rest on a horizontal surface when the portable tank assembly is in the operating position and a plurality of legs connecting the skid plate to the holding tank.

10 Claims, 14 Drawing Sheets

(51) Int. Cl.
*B65D 90/00* (2006.01)
*B65D 90/18* (2006.01)

(56) References Cited

U.S. PATENT DOCUMENTS

| | | | | | |
|---|---|---|---|---|---|
| 3,625,137 | A | | 12/1971 | Johnson | |
| 3,934,739 | A | * | 1/1976 | Zumsteg et al. | 414/332 |
| 4,241,744 | A | * | 12/1980 | Jordan, Sr. | 134/168 R |
| 4,621,972 | A | * | 11/1986 | Grotte | 414/477 |
| 4,626,166 | A | * | 12/1986 | Jolly | 414/812 |
| 4,778,111 | A | * | 10/1988 | Leap | 239/536 |
| 4,872,225 | A | * | 10/1989 | Wagner | 4/662 |
| 5,644,920 | A | | 7/1997 | Lak | |
| 6,386,559 | B1 | | 5/2002 | Souza | |
| 6,616,243 | B2 | | 9/2003 | Russell | |
| 6,715,515 | B2 | | 4/2004 | Klemme | |
| 7,214,028 | B2 | * | 5/2007 | Boasso et al. | 414/812 |
| 8,162,164 | B2 | | 4/2012 | Podd | |
| 2011/0203699 | A1 | | 8/2011 | Rodgers | |

OTHER PUBLICATIONS

Process Silos. Website with photos and manuals (online). Diversified Storage Systems, 2013 [retrieved on Jul. 17, 2013]. Retrieved from the Internet,URL:https://web.archive.org.web/20130717023611/http:www.cementsilos.com/index.php/projects/view/process-silos#web20130717023611im_/http://www.cement101.com/images-site>.

* cited by examiner

STORAGE APPARATUS HAVING TANK WITH TAPERED BOTTOM AND AXLE ASSEMBLY

CROSS REFERENCE TO RELATED APPLICATIONS

This application claims the benefit of U.S. Provisional Application No. 61/868,015 filed Aug. 20, 2013, which is incorporated herein by reference in its entirety.

FIELD OF THE INVENTION

The present invention relates generally to industrial equipment, and more particularly, to a storage apparatus for storing fluid materials.

BACKGROUND OF THE INVENTION

Holding tanks and other storage apparatuses are commonly used in industrial operations. Improvements to this technology are desired.

SUMMARY OF THE PREFERRED EMBODIMENTS

In accordance with a first aspect of the present invention there is provided a portable tank assembly that is movable between an operating position and a transport position that includes a tank assembly with a holding tank having an upper section that includes an upper wall and a lower section that includes a lower wall that tapers inwardly from the upper wall to form an orifice, a transport assembly that includes a base portion and an axle assembly. The base portion is affixed to the upper section of the holding tank, and the axle assembly includes wheels for transporting the holding tank along a surface, and a skid assembly that includes a skid plate configured to rest on a horizontal surface when the portable tank assembly is in the operating position and a plurality of legs connecting the skid plate to the holding tank. In a preferred embodiment, the base portion includes at least two base portion rail members and a plurality of base portion cross members connecting the base portion rail members, the axle assembly includes a frame that rotationally supports an axle that includes wheels on opposite ends thereof, and the axle assembly includes at least two axle assembly rail members and a plurality of axle assembly cross members connecting the axle assembly rail members. Preferably, the transport assembly includes at least two seat members extending between the base portion and the axle assembly, and in the operation position, at least a portion of the lower section of the holding tank is seated on the seat members. In a preferred embodiment, a first angle is defined between the upper wall and lower wall of the holding tank, and a second angle is defined between the base portion rail members and the seat members. The first angle and the second angle are approximately the same.

In a preferred embodiment, the holding tank includes a rinse assembly that comprises a supply pipe and a wash ring secured to an inside surface of the holding tank, and the wash ring includes a plurality of openings defined therein. Preferably, the plurality of openings comprises at least first and second sets of openings. The first set of openings is positioned between 1° and 45° counterclockwise from a top dead center of the wash ring and the second set of openings is positioned between 1° and 45° clockwise from a top dead center of the wash ring. Preferably, the wash ring includes a plurality of brackets secured about the circumference thereof that are secured to the inside surface of the holding tank.

In a preferred embodiment, the base portion includes a hitch assembly opposite the axle assembly and the tank assembly further comprises a recirculation manifold and recirculation return pipe.

In accordance with another aspect of the present invention there is provided a tank assembly that includes a holding tank having an upper section that includes an upper wall and a lower section that includes a lower wall that tapers inwardly from the upper wall to form an orifice, and a rinse assembly that comprises a supply pipe and a wash ring with a plurality of openings defined therein secured to an inside surface of the holding tank. In a preferred embodiment, the plurality of openings comprises at least first and second sets of openings. The first set of openings is positioned between 1° and 45° counterclockwise from a top dead center of the wash ring and the second set of openings is positioned between 1° and 45° clockwise from a top dead center of the wash ring.

In accordance with another aspect of the present invention there is provided a storage apparatus for storing fluid materials that includes a holding tank having an upper section and a lower section, the upper section comprising an upper wall with a non-tapered shape and the lower section comprising a lower wall with a tapered shape and a slope of approximately thirty degrees; and an axle assembly disposed adjacent to the holding tank, the axle assembly comprising a base that is affixable to the holding tank and at least one transport member for transporting the holding tank along a surface.

The invention, together with additional features and advantages thereof, may be best understood by reference to the following description.

BRIEF DESCRIPTION OF THE DRAWINGS

Like numerals refer to like components throughout the several view of the drawings.

DETAILED DESCRIPTION OF THE PREFERRED EMBODIMENTS

Figure 1:
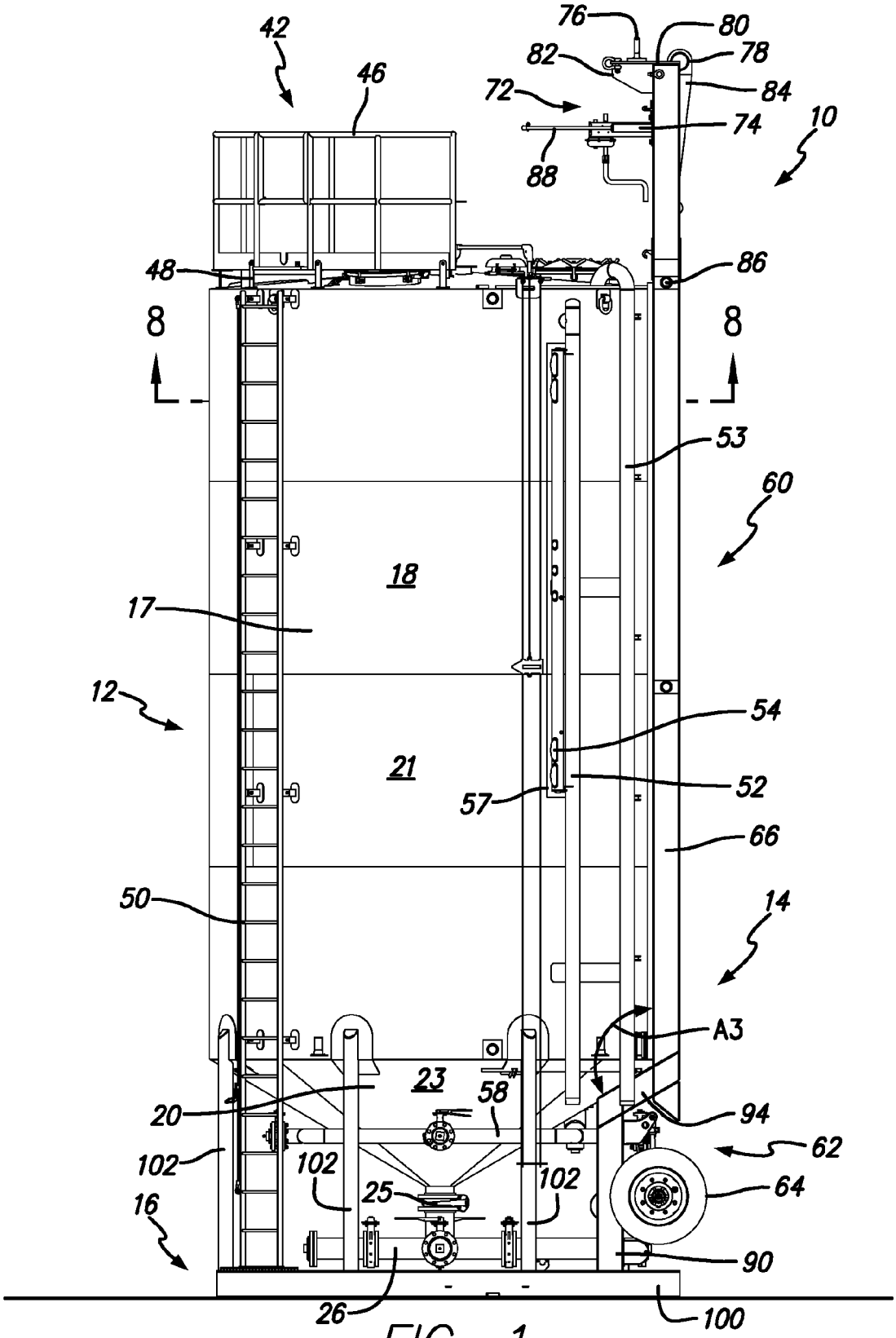
FIG. 1 is a side elevational view of a portable tank assembly in the operational position in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an other embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, FIGS. 1-10 show a portable tank assembly 10. The portable tank assembly 10 is movable between an operating position (see FIG. 1) and a transport position (see FIG. 2). It will be appreciated that, in a preferred embodiment, the transport position is approximately ninety degrees from the operating position. In use, the portable tank assembly 10 is more often in the operating position. Accordingly, any descriptive or orientation terms used herein, such as "upper," "lower," "vertical," "horizontal," etc. refer to the portable tank assembly 10 in the operating position (shown in FIG. 1) unless stated otherwise.

Figure 2:
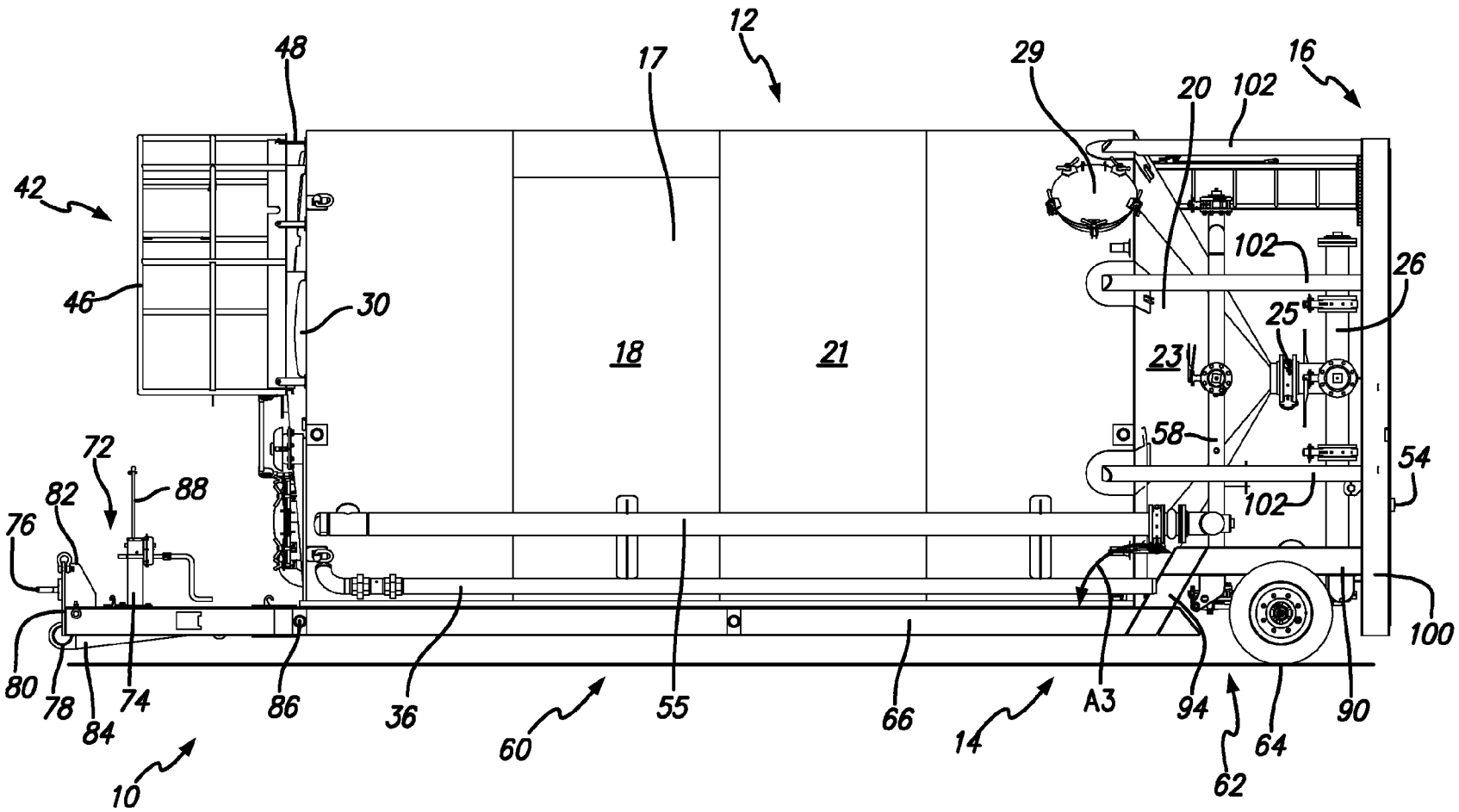
FIG. 2 is a is a side elevational view of the portable tank assembly of FIG. 1 in the transport position

As shown in FIGS. 1-2, in a preferred embodiment, the portable tank assembly 10 generally includes a holding tank assembly 12, a transport assembly 14 and a skid assembly 16. In a preferred embodiment, the holding tank assembly 12 includes a holding tank 17 comprised of a cylindrically shaped upper section 18 and a lower section 20 that depends downwardly and tapers inwardly from the upper section 18. In a preferred embodiment, the lower section is conically shaped, as shown in the figures. However, it will be appreciated by those of ordinary skill in the art that both the upper section 18 and the lower section 20 can be comprised of walls that meet at an angle (e.g., a square cross-section). In a preferred embodiment, the wall(s) 21 of the upper section 18 are generally vertically oriented and have a non-tapered shape and the wall(s) 23 of the lower section 20 tapered inwardly from wall 21. As is shown in FIG. 3, the upper section 18 also includes a cover or top 32.

Figure 3:
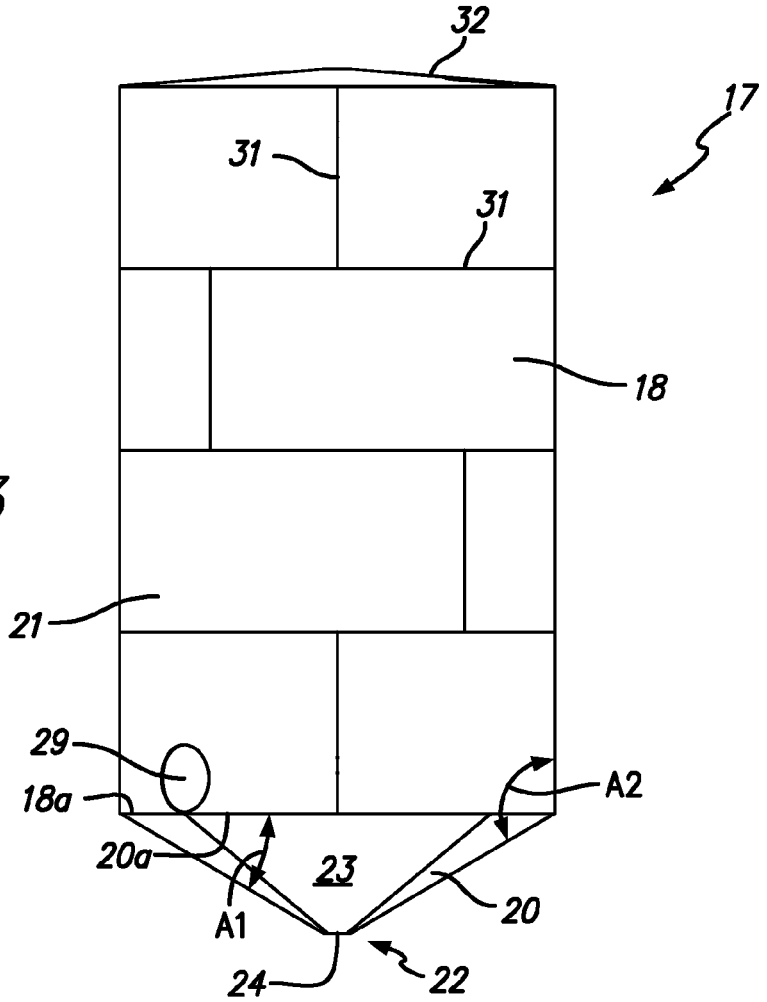
FIG. 3 is a side elevational view of the holding tank.
Figure 4:
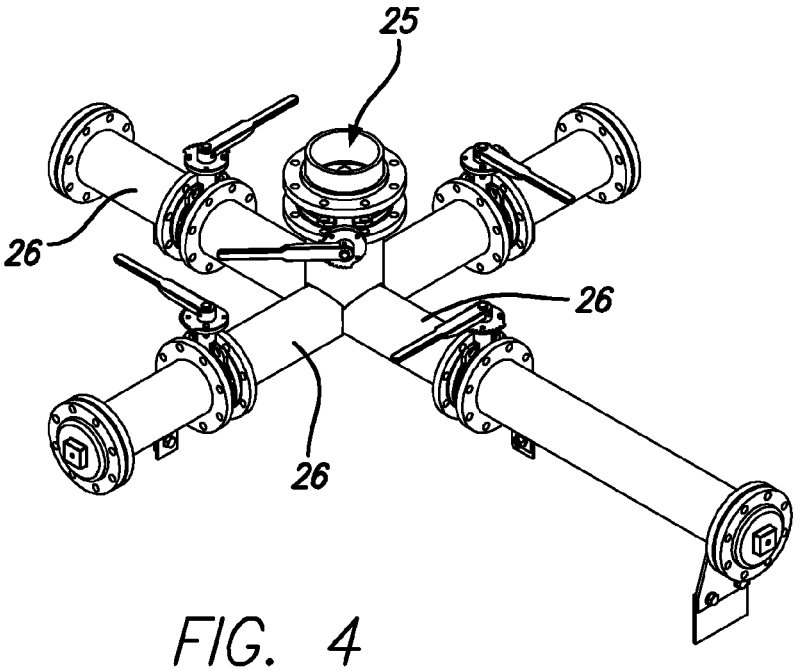
FIG. 4 is a perspective view of the nozzle and piping assembly that is connected to the tip of the holding tank.
Figure 5:
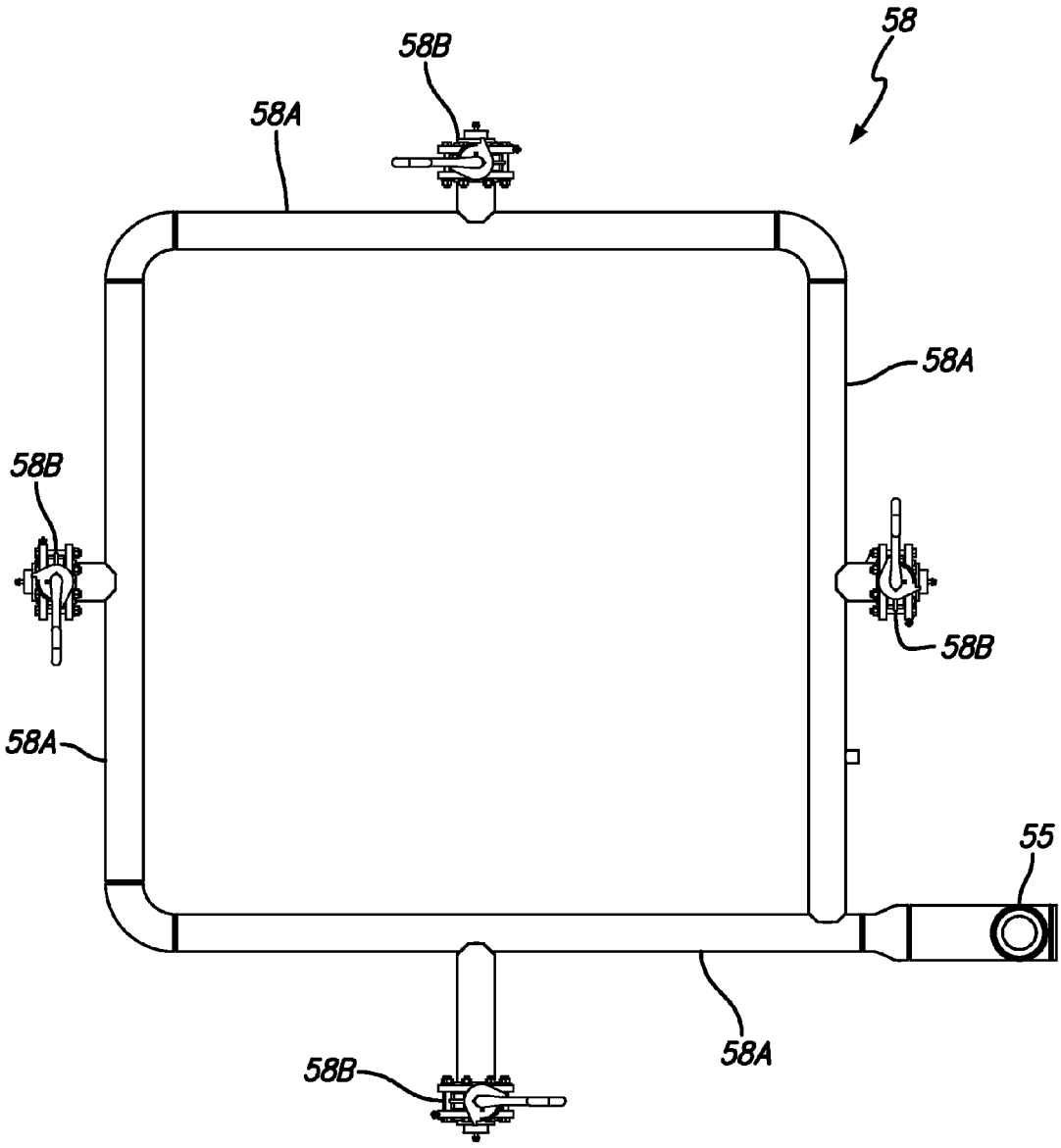
FIG. 5 is a top elevational view of the recirculation manifold of the portable tank assembly of FIG. 1.
Figure 6:
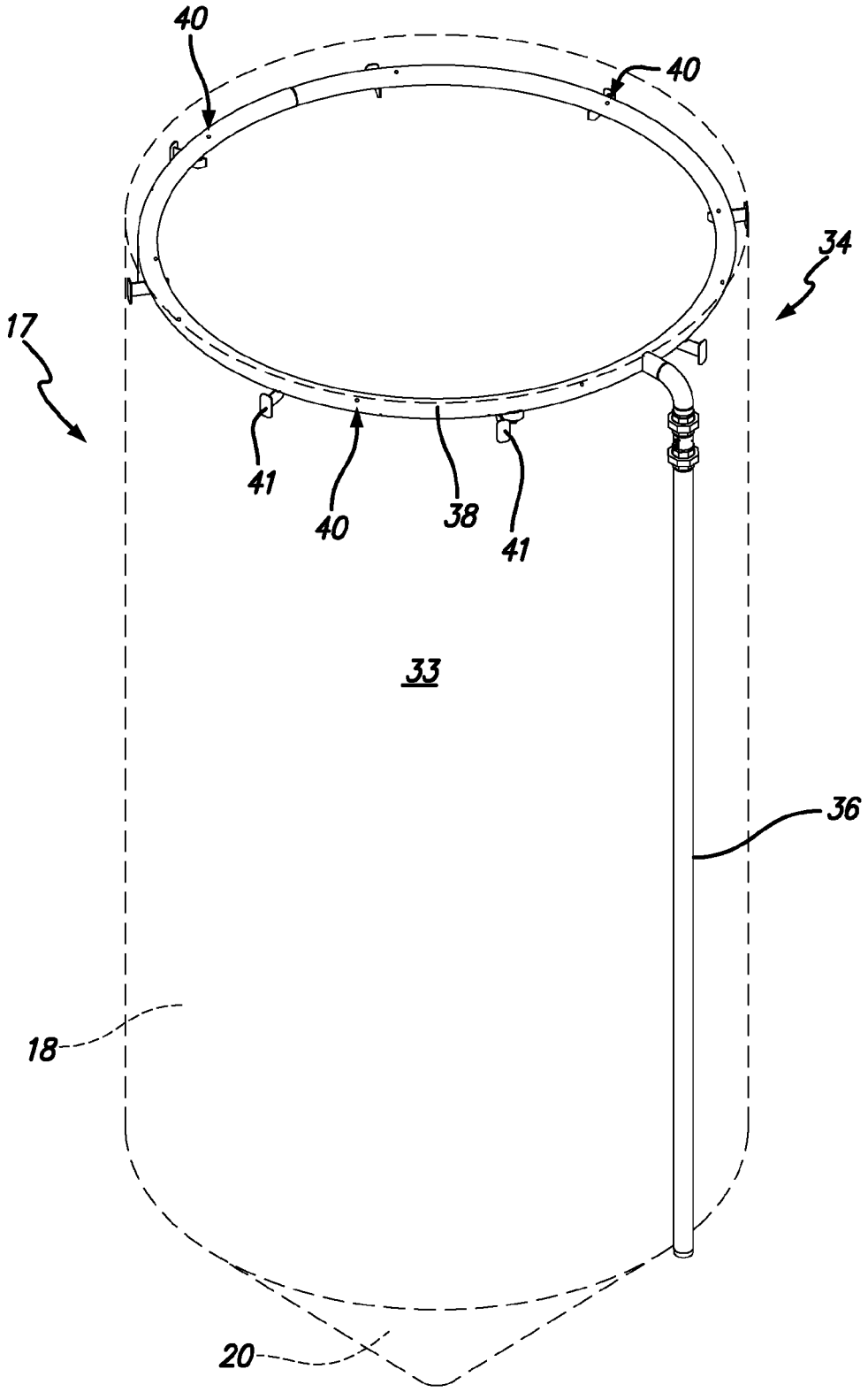
FIG. 6 is a perspective view of the rinse assembly and showing the holding tank in hidden lines.

As shown in FIGS. 1-3, the tapered shape of the lower section 20 forms a tip 22. An orifice 24 is disposed at or near tip 22. The contents of holding tank 17 can be emptied though orifice 24 via, for example, one or more nozzles 25 and relating piping 26 (described below), as shown in FIGS. 1 and 4.

As shown in FIG. 3, the lower section 20 includes a top edge 20*a* that abuts and is affixed to the bottom edge 18*a* of the upper section 18. In certain illustrative embodiments, the slope or angle A1 between the bottom edge 18*a* of the upper section and the wall 23 of the lower section 20 can be approximately thirty degrees. In other embodiments, angle A1 can be between twenty degrees and forty degrees. This sloped lower section 20 allows the fluid material inside of holding tank 17 to flow to tip 22 more easily (compared to the prior art), especially for viscous materials. This helps minimize the amount of material held inside of holding tank 17 during each use. In addition, when holding tank 17 is ready to be transported to a new location, the amount of cleanup inside holding tank 17 is greatly reduced.

In use, the holding tank 17 can be used to store drilling mud, petroleum based products, water or any other fluid material used in industrial operations. Holding tank 17 may be made of any suitable material, including steel or plastic, and may be formed using any conventional technique. For example, FIG. 3 shows the holding tank 17 with a plurality of seams 31 representing the welding together of a plurality of steel plates. In a preferred embodiment, holding tank 17 can have a 420 barrel capacity. However, this is not a limitation on the present invention and the holding tank interior 33 can have any desired capacity.

With reference to FIGS. 1-5, some of the various pipes will now be described. Pipes 26 (see FIG. 4), which are connected to nozzle 25 are used to transport the contents to a preferred destination. In a preferred embodiment pipes 26 include suction for pulling the contents out of the bottom of the holding tank 17 and through tip 22. In a preferred embodiment, the holding tank 17 includes a recirculation manifold 58 (see FIG. 5), which allows a plurality of holding tanks 17 to be connected. For example, tanks are often placed side by side in rows. The recirculation manifold allows the contents (e.g., mud) to be transferred and circulated between tanks. Preferably, the recirculation manifold 58 includes four sections 58*a* that form a ring (circular or square, as shown) that surrounds an exterior portion of the lower wall 23 of the holding tank 17. Each of the sections 58*a* includes a pipe or connection 58*b* extending therefrom that allows other tanks to be positioned on up to all four sides. This provides a plurality of positioning options to connect tanks together.

As shown in FIG. 1, preferably, the holding tank assembly 12 includes a fill pipe 52 through which contents is injected into the holding tank 17 and an overflow pipe 53 that diverts excess contents to the exterior of the holding tank 17 (e.g., to the ground).

As shown in FIG. 2, the tank assembly preferably includes a supply pipe 36 for a rinse assembly 34 (described below) and a recirculation return pipe 55 that is connected to the recirculation manifold 58. The recirculation return pipe 55 extends along the exterior of the holding tank 17 from the recirculation manifold 58 to an opening in the upper wall 21 of the tank and provides the ability to circulate or turnover the volume inside of the tank so that it is moving and kept mixed.

As shown in the figures, the holding tank 17 includes various openings, inlets, outlets or hatches, etc. for access to the interior 33 of the holding tank 17. The positioning, number and operation of the openings and hatches are not a limitation on the present invention. As shown in FIG. 2, the holding tank assembly 12 preferably includes and inspection hatch 29 near the bottom of the holding tank 17 for when the portable tank assembly 10 is in the operating position and one or more inspection hatches 30 on the cover 32 for when the portable tank assembly 10 is in the transport position (see also FIG. 8).

Figure 8:
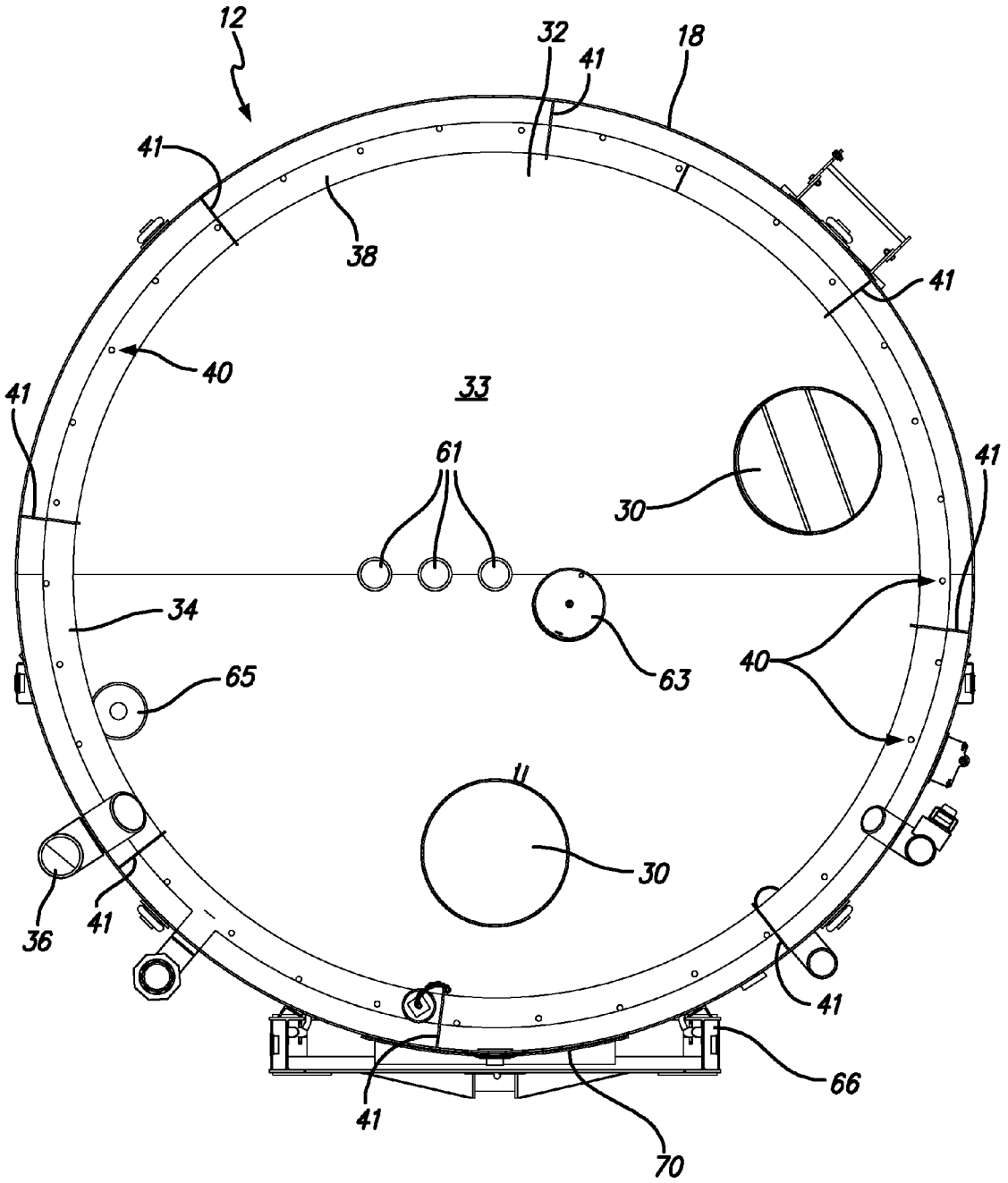
FIG. 8 is a cross sectional view taken along line 8-8 of FIG. 1.

As shown in FIG. 8, in a preferred embodiment, the cover 32 includes connections (e.g., threaded connections) for instrumentation 61 therein. Instrumentation such as a level transmitter or switch (for when the tank is being filled and it gets to a predetermined point an alarm can be sounded or a pump shut off), a radar gauge, a vent or breathing pipe for connecting adjacent tanks so that they all fill and empty at the same rate and all that. In an exemplary embodiment, the center instrumentation connection 61 is used for a radar level indicator, the adjacent one is used for a level switch and the third one is for interconnecting the head space on adjacent tanks. FIG. 8 also shows a mechanical liquid level gauge 63 and a pressure relief valve 65.

As is shown in FIGS. 5-7B, in a preferred embodiment, the holding tank assembly 12 includes rinse assembly 34 for helping clean the interior 33 of the holding tank 17. In a preferred embodiment, the rinse assembly 34 includes supply pipe 36 and wash ring 38 (round shaped in this embodiment, but could be square in an embodiment with walls that meet at angles) having a plurality of openings 40 therein. The wash ring 38 can be secured to the wall 21 of the upper section 18 via brackets 41 or the like. In use, water or other liquid is delivered to the wash ring 38 via the supply pipe 36 (which extends through an opening in the holding tank 17 and is in communication with a fluid source at its distal end) and is forced through the openings 40 and sprayed on the inside of the holding tank 17.

Figure 7A:
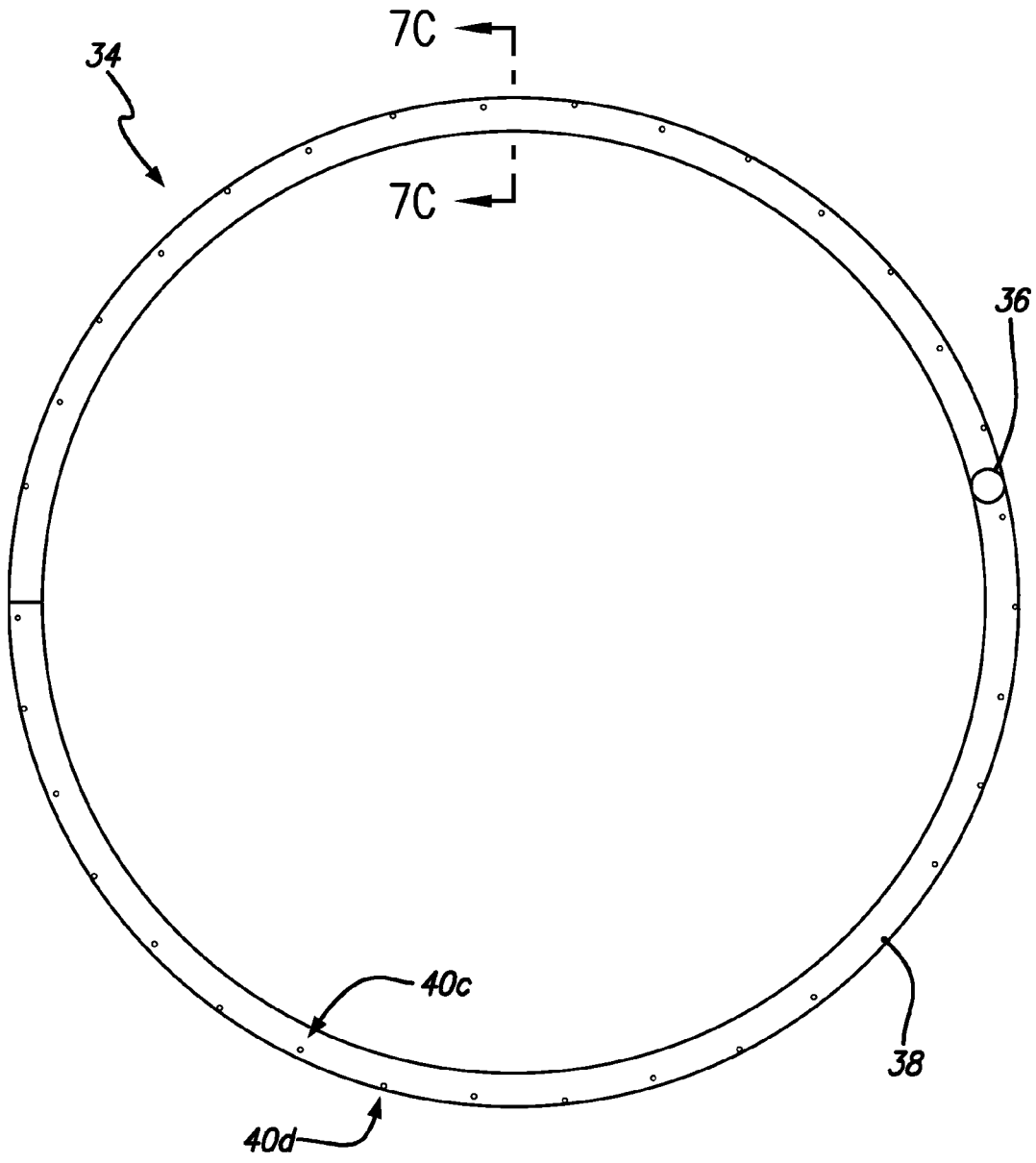
FIG. 7A is a bottom view of the wash ring of the rinse assembly.
Figure 7B:
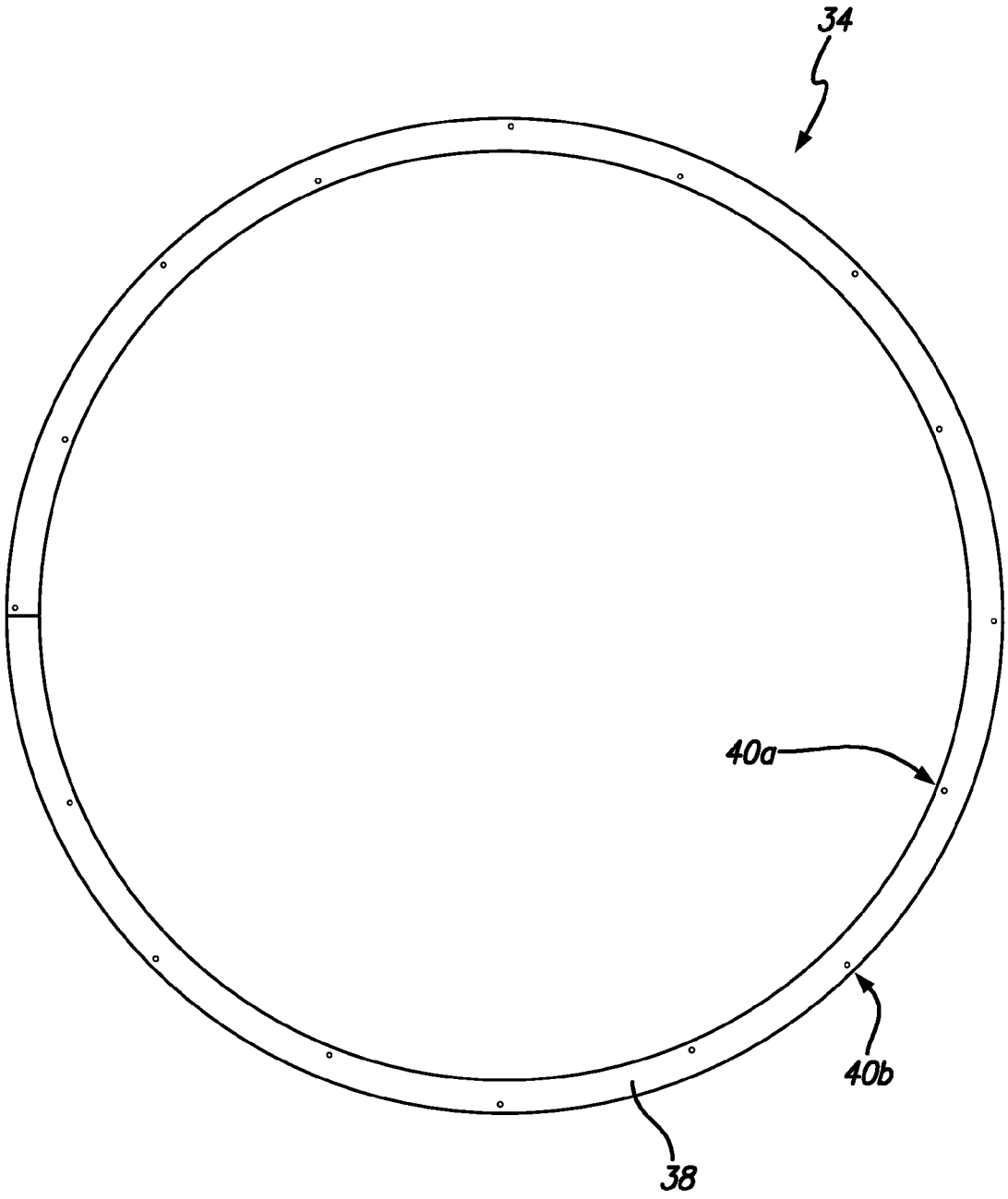
FIG. 7B is a top view of the wash ring of the rinse assembly
Figure 7C:
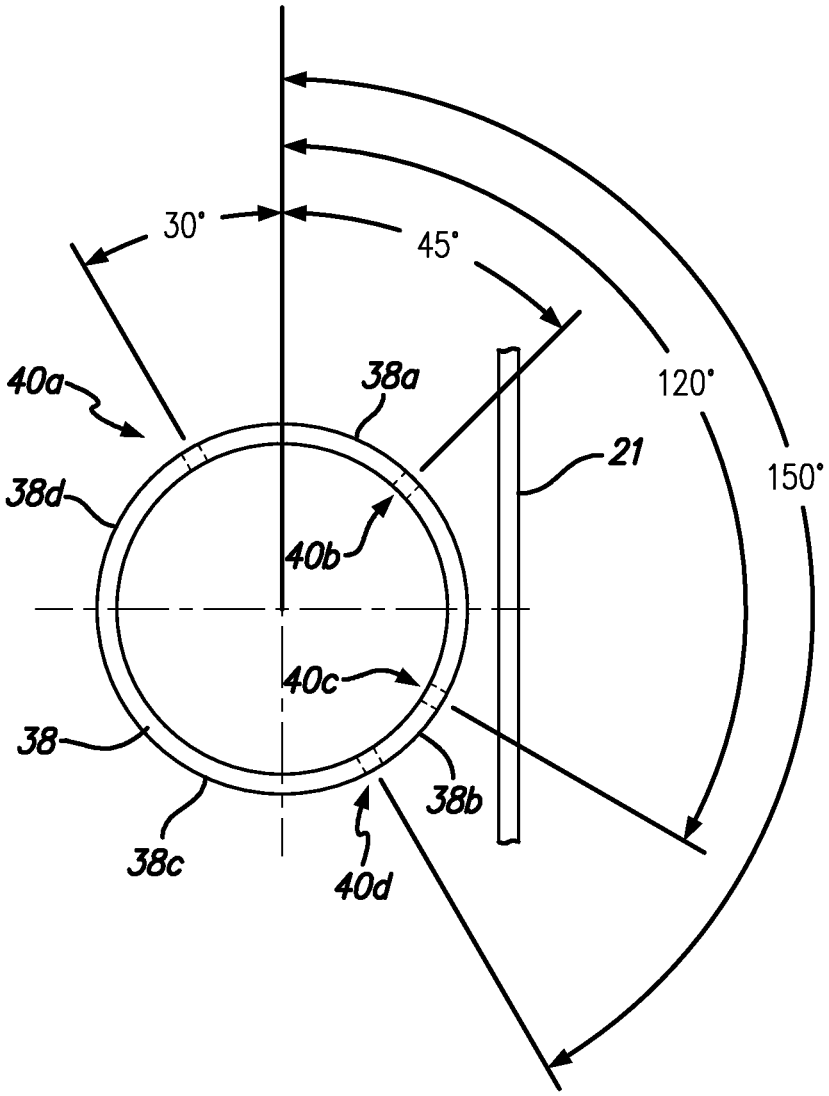
FIG. 7C is a cross-sectional view taken along line 7C-7C of FIG. 7A.

FIGS. 7A-7B show an exemplary embodiment of a wash ring 38 that includes openings therein that the inventors have found provides thorough coverage of the interior of the holding tank 17. As shown in FIG. 7C, in this embodiment, the wash ring 38 includes four sets of openings 40 defined therein. The first set 40*a* is approximately 30° from the top dead center (twelve o'clock) of the wash ring 38 in a counterclockwise direction. The second set 40*b* is approximately 45° from the top dead center of the wash ring 38 in a clockwise direction. The third set 40*c* is approximately 120° from the top dead center of the wash ring 38 in a clockwise direction. The fourth set 40*d* is approximately 150° from the top dead center of the wash ring 38 in a clockwise direction. In this embodiment, the first set 40*a* includes eight openings, the second set 40*b* includes eight openings, the third set 40*c* includes sixteen openings, and the fourth set 40*d* includes seventeen openings. Each set of openings is spaced equally about the 360° wash ring 38.

Another way of describing the openings 40 in the wash ring 38 is that the wash ring 38 is divided into first, second, third and fourth quadrants 38*a*, 38*b*, 38*c* and 38*d*. As shown in FIG. 7C, the first and second quadrants 38*a* and 38*b* are adjacent the upper wall 21 and the third and fourth quadrants 38*c* and 38*d* face away from the upper wall 21. The first set 40*a* of openings is positioned in the fourth quadrant 38*d*, the second set 40*b* of openings is positioned in the first quadrant 38*a*, and the third and fourth sets 40*c* and 40*d* of openings are positioned in the second quadrant 38*b*.

The angle of each of the openings from top dead center and the number of openings in each set is not a limitation on the present invention. For example, the first set can be between 1° and 90° counterclockwise from top dead center, the second set can be between 1° and 90° clockwise from top dead center, and the third and fourth sets can be between 90° and 180° from top dead center. Other openings can be included that are between 90° and 180° counterclockwise from top dead center.

Figure 9:
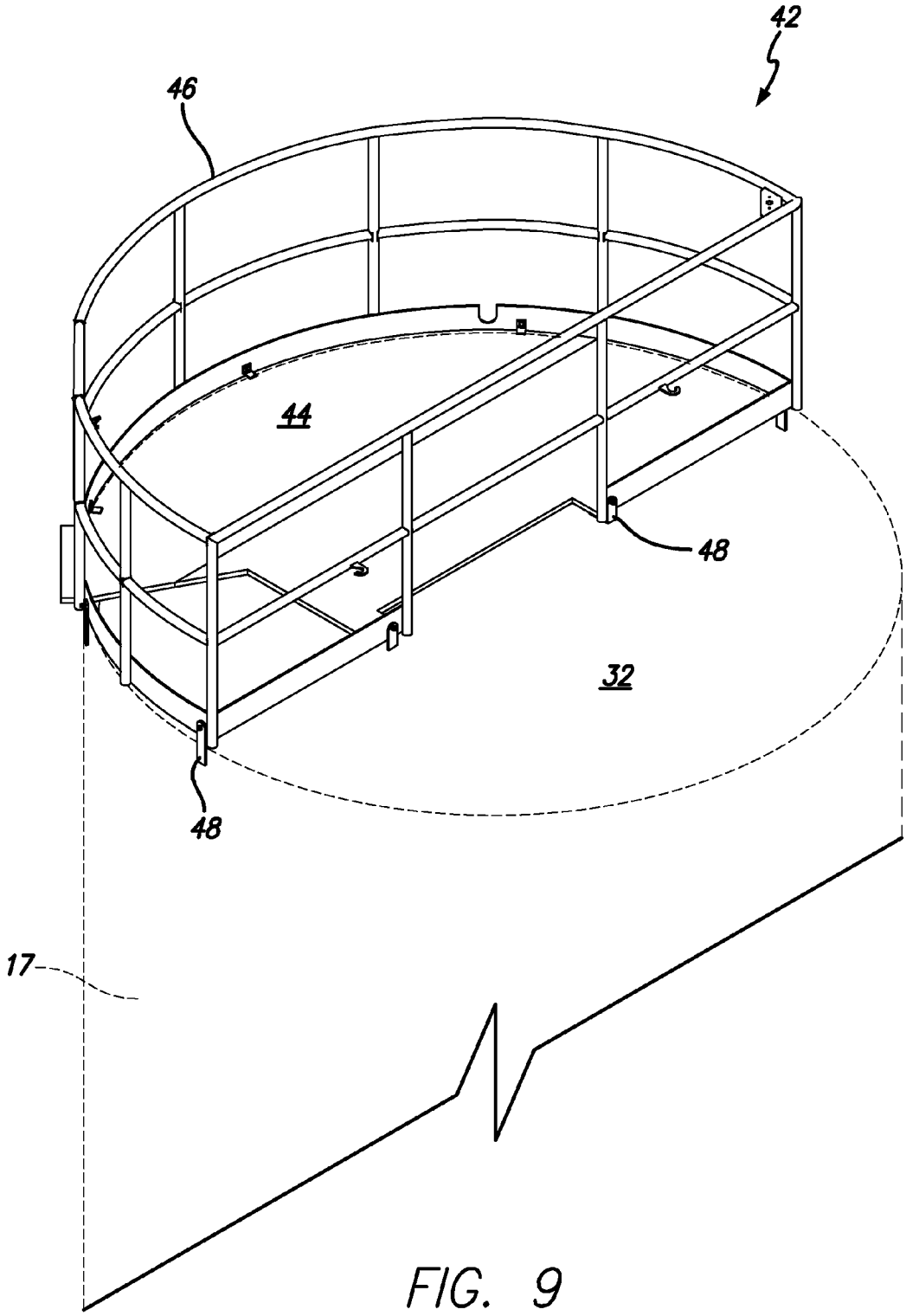
FIG. 9 is a perspective view of the railing assembly and showing the holding tank in hidden lines.

As shown in FIGS. 1-2 and 9, in a preferred embodiment, the holding tank assembly 12 includes a railing assembly 42 positioned on the cover 32 of the holding tank 17. Preferably, the railing assembly 42 comprises a floor 44 and a railing frame 46 and is permanently affixed to the cover 32 via brackets 48 or the like. In another embodiment, the railing assembly 42 can be removable. In a preferred embodiment, the holding tank assembly 12 includes a ladder 50 for accessing the top of the holding tank 17, and, in particular, the railing assembly 42.

Figure 10:
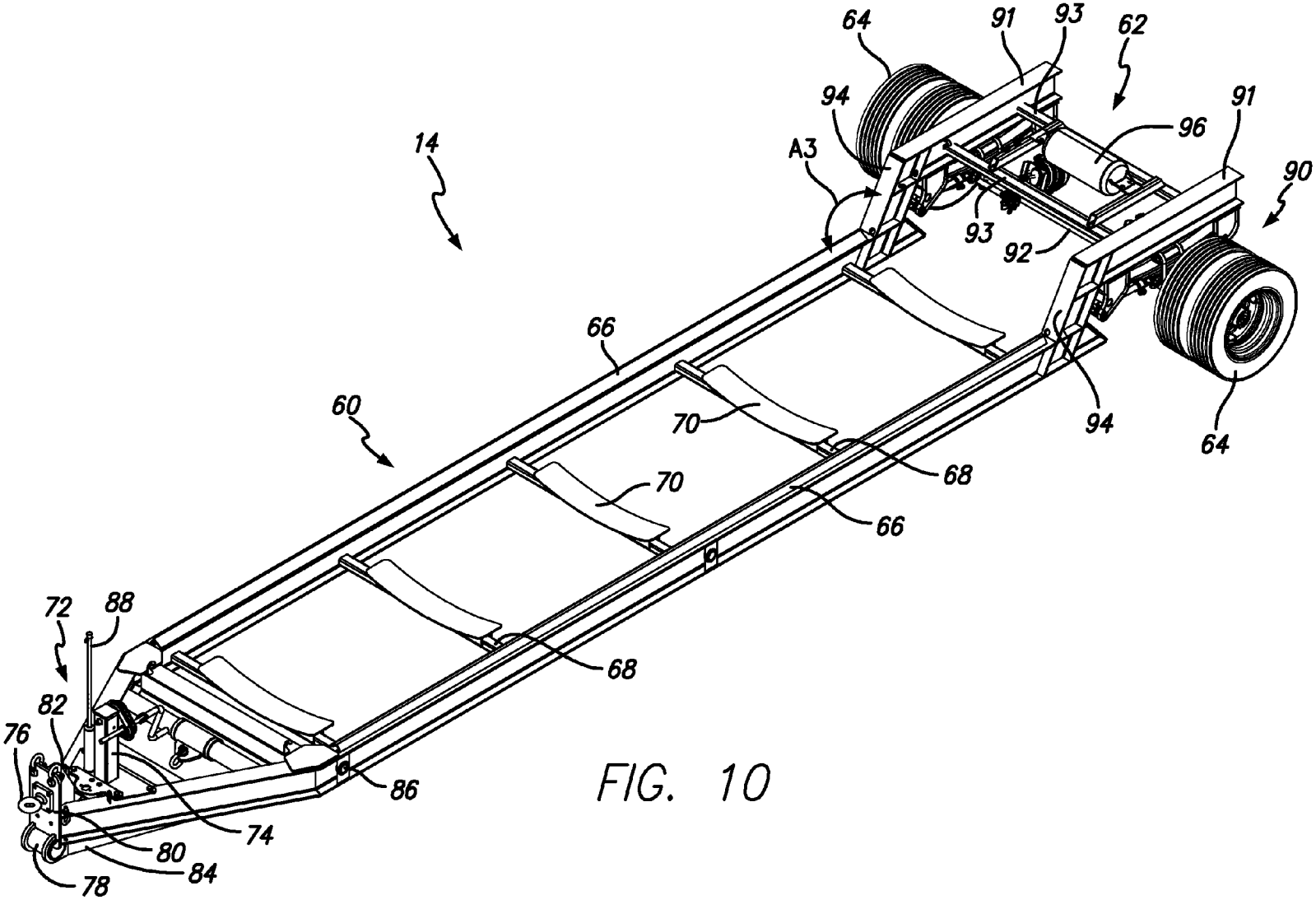
FIG. 10 is a perspective view of the transport assembly.

In a preferred embodiment, as shown in FIGS. 1-2 and 10, portable tank assembly 10 includes transport assembly 14 disposed adjacent to holding tank assembly 12. In a preferred embodiment transport assembly 14 is permanently affixed to holding tank assembly 12. In another embodiment, transport assembly 14 is removeably affixable with respect to holding tank assembly 12.

Preferably, the transport assembly 14 includes a base portion 60 and an axle assembly 62 that includes at least one transport member or wheel 64 for transporting the portable tank assembly 10 along a surface. As shown in FIG. 10, in a preferred embodiment, the base portion 60 includes at least two base portion frame rail members 66 that are connected by a plurality of base portion cross members 68. Preferably, the base portion cross members 68 each include a saddle member 70 for supporting the holding tank 17. Preferably each saddle member 70 has a concave surface with a shape similar to the outer surface of the upper section 18. The base portion 60 also preferably includes a hitch assembly 72 that includes components for securing the transport assembly 14 to a truck. For example, the hitch assembly 72 can include a jack 74, a pintle hitch 76, a cable bumper 78, a front plate 80, a pintle hitch plate gusset 82, a winch riser 84, a cable hook, Crosby eye bolt, marker lights 86, pogo stick 88 and other components known in the trailer art.

The axle assembly 62 preferably includes a frame 90 for rotationally supporting at least one axle 92, at least two axle assembly rail members 91, and axle assembly cross members 93. As shown in FIG. 8, in a preferred embodiment, the transport assembly includes at least two seat members 94 that extend between and connect the base portion 60 to the axle assembly 62. In a preferred embodiment, the seat members 94 extend at an angle between and connect the base portion rail members 66 to the axle assembly rail members 91. As shown in FIG. 1, when the portable tank assembly 10 is in the operation position, the lower section 20 of the holding tank 17 is seated on the seat members 94. In the operation position, the angle A2 between the vertical wall 21 of the upper section 18 and the wall 23 of the lower section (see FIG. 3) is approximately the same as the angle A3 between each base portion rail member 66 and the associated seat member 94 (see FIGS. 1 and 10). In a preferred embodiment, A2 and A3 are between about 100° and about 170°. In a more preferred embodiment, A2 and A3 are between about 110° and about 130°. In the most preferred embodiment, A2 and A3 are about 120°. In embodiments of the invention, the axle assembly 62 can include other components, such as an air tank 96, brakes, marker lights, reflectors, etc.

As shown in FIGS. 1-2 and 11A-12, in a preferred embodiment, the skid assembly 16 includes a skid plate 100 and a plurality of legs 102. Preferably, the legs 102 are positioned about the periphery of the holding tank 17 and extend between and are connected to the skid plate 100 and the holding tank 17. Preferably, the base portion 60 is connected to the skid plate 100 (e.g., at frame 90).

Figure 11A:
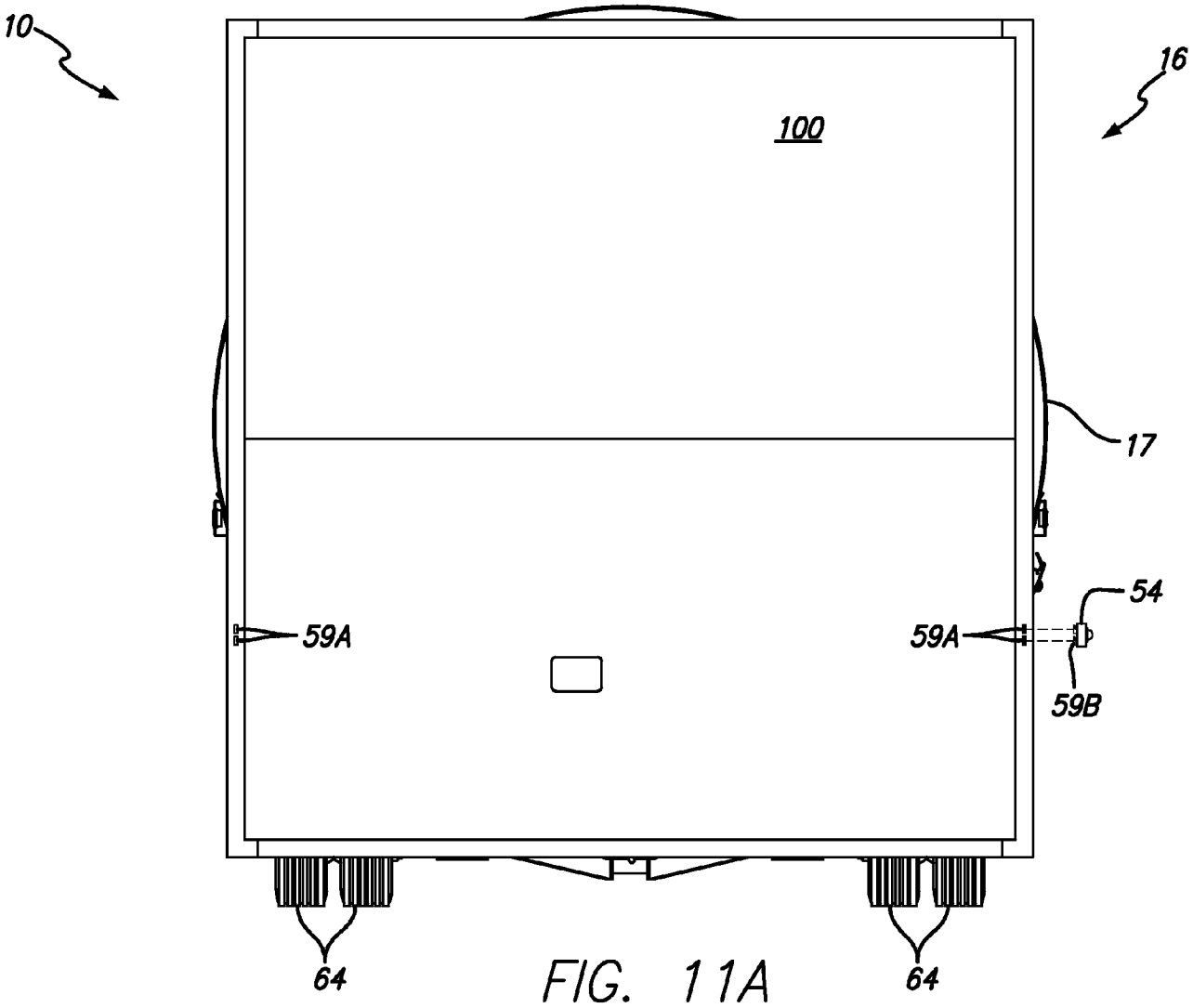
FIG. 11A is a rear elevational view of the portable tank assembly of FIG. 1 with the light bar exploded therefrom.
Figure 11B:
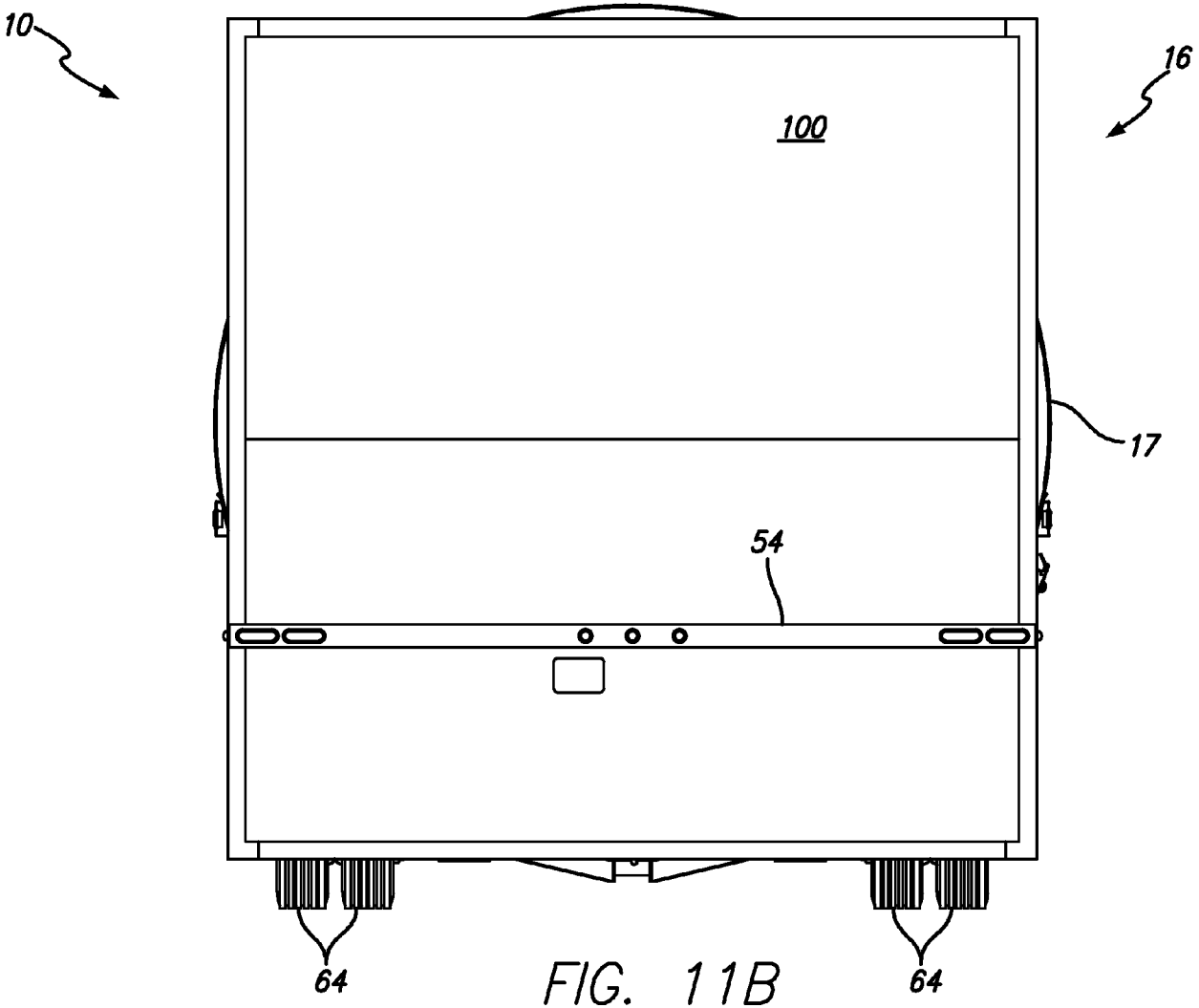
FIG. 11B is a rear elevational view of the portable tank assembly of FIG. 1 with the light bar secured to the skid plate.
Figure 12:
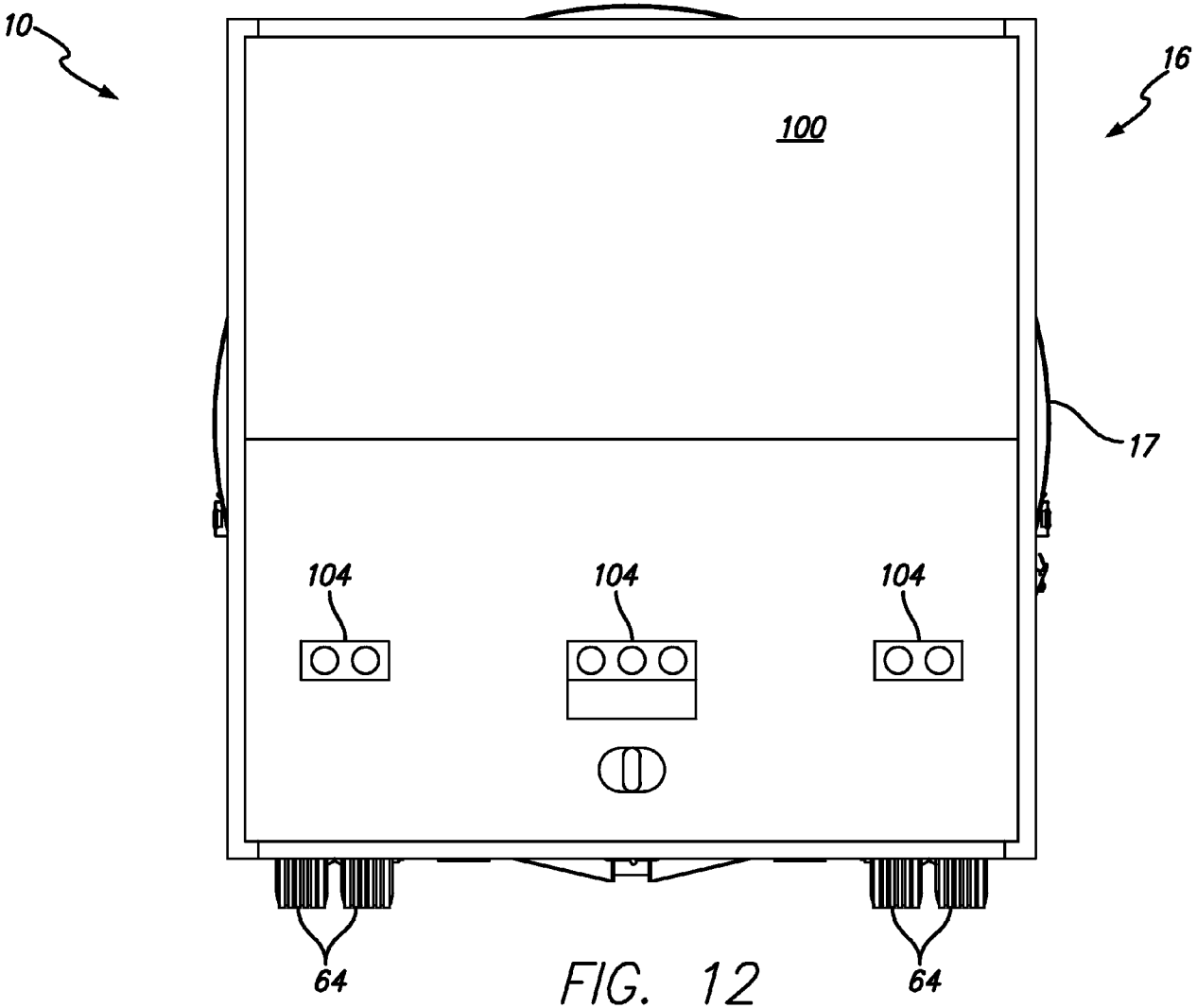
FIG. 12 is a rear elevational view of an embodiment of the portable tank assembly of FIG. 1 where the skid plate includes lights embedded therein.

It will be appreciated that in the transport position, the skid plate 100 forms the back of the portable tank assembly 10. Therefore, in a preferred embodiment, as is shown in FIGS. 11A-12, the skid plate 100 includes brake and running lights 104 thereon. As shown in FIGS. 1, 2 and 11A-11B, in a preferred embodiment, the portable tank assembly 10 includes lighting 54 that is movable between a storage position (FIG. 1), for when the portable tank assembly 10 is in the operation position and a use position (FIGS. 2 and 11B) for when the portable tank assembly is in the transport position. It will be appreciated that any lights discussed herein include wiring such that electricity can be provided thereto. The portable tank assembly 10 can include a power supply or a wire harness can be provided for connecting the wiring of the portable tank assembly 10 to the vehicle being used to transport the portable tank assembly 10. Preferably, the lighting 54 is a movable light bar 54 that is positioned on the skid plate 100 (FIG. 11B) in the use position and somewhere away from the skid plate 100 in the storage position so that it will not be crushed. FIGS. 11A-11B illustrate the skid plate 100 without the light bar 54 (FIG. 11A) and with the light bar 54 (FIG. 11B) secured thereto. The light bar 54 can be connected to the skid plate 100 in any desired way. As shown in FIG. 11A, in a preferred embodiment, the skid plate 100 includes openings 59A therein that receive hooks or connectors 59B on the back of the light bar 54 to connect the light bar 54 to the skid plate 100. As shown in FIG. 1, the light bar 54 is positioned on a storage plate 57 that is connected to the fill pipe 52. The storage plate 57 includes openings therein similar to the openings 59A in the skid plate 100. Connection to the fill pipe 52 is not a limitation on the present invention. The light bar can be connected to another pipe, the trailer, the ladder or any other place where it can be stored away from the bottom of the skid plate 100. Any type of connection to the skid plate 100 or storage plate 57 is within the scope of the present invention. For example, threaded fasteners (e.g., bolts, screws, etc.), magnets, Velcro or other fastening devices can be used. In another embodiment, as shown in FIG. 12, the skid plate 100 can include lights 104 embedded therein or permanently attached thereto.

In a preferred embodiment, many of the components of the portable tank assembly 10 are made of metal and are therefore secured to one another by welding. However, this is not a limitation on the present invention and the various components can be connected via other means. In the operation position, the skid plate 100 forms the base that supports the entire portable tank assembly 10, as is shown in FIG. 1.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A portable tank assembly that is movable between an operating position and a transport position, the portable tank assembly comprising:

a tank assembly that includes a holding tank having an upper section that includes an upper wall and a lower section that includes a lower wall that tapers inwardly from the upper wall to form an orifice, wherein the holding tank defines a center axis, a transport assembly that includes a base portion and an axle assembly, wherein the base portion is affixed to the upper section of the holding tank, wherein the base portion includes at least first and second base portion rail members that extend generally parallel to the center axis of the holding tank, wherein the axle assembly includes a frame that rotationally supports an axle that includes wheels on opposite ends thereof for transporting the holding tank along a surface, and wherein the axle assembly includes at least first and second axle assembly rail members that extend generally parallel to the center axis of the holding tank, wherein the transport assembly includes first and second seat members each having first and second opposite ends, wherein the first end of the first seat member is directly connected to the first base portion rail member and the second end of the first seat member is directly connected to the first axle assembly rail member, wherein the first end of the second seat member is directly connected to the second base portion rail member and the second end of the second seat member is directly connected to the second axle assembly rail member, and wherein in both the transport position and the operation position, at least a portion of the lower section of the holding tank is seated on the first and second seat members, and a skid assembly that includes a skid plate configured to rest on a horizontal surface when the portable tank assembly is in the operating position and a plurality of legs connecting the skid plate to the holding tank.

2. The portable tank assembly of claim 1 wherein the base portion includes a plurality of base portion cross members connecting the base portion rail members, and wherein the axle assembly includes a plurality of axle assembly cross members connecting the axle assembly rail members.

3. The portable tank assembly of claim 1 wherein in both the transport position and the operating position the first and second base portion rail members and the first and second axle assembly rail members extend generally parallel to the center axis of the holding tank.

4. The portable tank assembly of claim 1 wherein a first angle is defined between the upper wall and lower wall of the holding tank, wherein a second angle is defined between the base portion rail members and the seat members, wherein the first angle and the second angle are approximately the same.

5. The portable tank assembly of claim 1 wherein the holding tank includes a rinse assembly that comprises a supply pipe and a wash ring secured to an inside surface of the holding tank, wherein the wash ring includes a plurality of openings defined therein.

6. The portable tank assembly of claim 5 wherein the plurality of openings comprises at least first and second sets of openings, wherein the first set of openings is positioned between 1° and 45° from a top dead center of the wash ring in an inward direction away from the inside surface of the holding tank and the second set of openings is positioned between 1° and 45° from the top dead center of the wash ring in an outward direction toward the inside surface of the holding tank.

7. The portable tank assembly of claim 6 wherein the wash ring includes a plurality of brackets secured about the circumference thereof, wherein the brackets are secured to the inside surface of the holding tank.

8. The portable tank assembly of claim 4 wherein the base portion includes a hitch assembly opposite the axle assembly.

9. The portable tank assembly of claim 1 wherein the tank assembly further comprises a recirculation manifold and a recirculation return pipe.

10. The portable tank assembly of claim 1 wherein the first and second axle assembly rail members are connected to the skid plate.

* * * * *